US008205464B2

(12) United States Patent
Kasahara et al.

(10) Patent No.: US 8,205,464 B2
(45) **Date of Patent: *Jun. 26, 2012**

(54) REFRIGERATION DEVICE

(75) Inventors: Shinichi Kasahara, Sakai (JP); Toshiyuki Kurihara, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 642 days.

This patent is subject to a terminal disclaimer.

(21) Appl. No.: 12/439,954

(22) PCT Filed: Aug. 30, 2007

(86) PCT No.: PCT/JP2007/066846

§ 371 (c)(1),
(2), (4) Date: Mar. 4, 2009

(87) PCT Pub. No.: WO2008/032578

PCT Pub. Date: Mar. 20, 2008

(65) Prior Publication Data

US 2010/0037641 A1 Feb. 18, 2010

(30) Foreign Application Priority Data

Sep. 11, 2006 (JP) ..... 2006-246152

(51) Int. Cl.
*F25B 41/00* (2006.01)
*F25B 41/04* (2006.01)

(52) U.S. Cl. ..... 62/210; 62/205; 62/208

(58) Field of Classification Search ..... 62/210, 62/208, 205, 222, 190, 498
See application file for complete search history.

(56) References Cited

U.S. PATENT DOCUMENTS

| | | | | |
|---|---|---|---|---|
| 6,044,655 | A * | 4/2000 | Ozaki et al. | 62/205 |
| 2006/0277932 | A1 * | 12/2006 | Otake et al. | 62/196.1 |
| 2010/0037647 | A1 * | 2/2010 | Kurihara et al. | 62/434 |

FOREIGN PATENT DOCUMENTS

| | | | |
|---|---|---|---|
| JP | 62-158954 | A | 7/1987 |
| JP | 10-115470 | A | 5/1996 |
| JP | 10-148404 | A | 6/1996 |
| JP | 08-35725 | A | 1/2001 |
| JP | 2001-4235 | A | 1/2001 |
| JP | 2002-106959 | A | 4/2002 |
| JP | 2002-168536 | A | 6/2002 |
| JP | 2004-100979 | A | 4/2004 |
| JP | 2005-214443 | A | 8/2005 |
| JP | 2005-226866 | A | 8/2005 |

OTHER PUBLICATIONS

Office Action of corresponding Japanese Application No. 2006-246152 dated Jul. 19, 2011.

* cited by examiner

*Primary Examiner* — Chen Wen Jiang
(74) *Attorney, Agent, or Firm* — Global IP Counselors

(57) ABSTRACT

A refrigeration device includes a compression mechanism, a radiator, a first expansion mechanism, a liquid receiver, a second expansion mechanism, an evaporator, a pressure detector, a temperature detector, and a control unit. The pressure detector is provided between the refrigerant discharge side of the compression mechanism and the refrigerant inflow side of the first expansion mechanism. The temperature detector is provided between the exit side of the radiator and the refrigerant inflow side of the first expansion mechanism. The control unit controls the first expansion mechanism using the pressure detected by the pressure detector and the temperature detected by the temperature detector so that the refrigerant flowing out from the first expansion mechanism reaches a saturated state.

9 Claims, 4 Drawing Sheets

REFRIGERATION DEVICE

CROSS-REFERENCE TO RELATED APPLICATIONS

This U.S. National stage application claims priority under 35 U.S.C. §119(a) to Japanese Patent Application No. 2006-246152, filed in Japan on Sep. 11, 2006, the entire contents of which are hereby incorporated herein by reference.

TECHNICAL FIELD

The present invention relates to a refrigeration device, and particularly relates to a refrigeration device in which the refrigerant attains a supercritical state during the refrigeration cycle.

BACKGROUND ART

Conventional refrigeration devices are widely known that are provided with a refrigerant circuit in which a compressor, a radiator, a first expansion valve, a liquid receiver, a second expansion valve, and an evaporator are connected in sequence (see Japanese Laid-open Patent Application No. 10-115470, page 4, fifth column, line 12 through page 5, seventh column, line 39; FIG. 3, for example).

SUMMARY OF THE INVENTION

Technical Problem

In the refrigerant circuit of such a refrigeration device, a large amount of refrigerant gas is generated and the refrigerant level in the liquid receiver is difficult to be controlled when the pressure (hereinafter referred to as intermediate pressure) of the refrigerant flowing from the first expansion valve to the second expansion valve is caused to be much lower than the saturation pressure.

An object of the present invention is to enable the refrigerant level in the liquid receiver to be stably controlled in a refrigeration device such as the one described above.

Solution to Problem

A refrigeration device according to a first aspect of the present invention comprises a compression mechanism, a radiator, a first expansion mechanism, a liquid receiver, a second expansion mechanism, an evaporator, a pressure detector, a temperature detector, and a control unit. The compression mechanism compresses a refrigerant. The radiator is connected to a refrigerant discharge side of the compression mechanism. The first expansion mechanism is connected to an exit side of the radiator. The liquid receiver is connected to a refrigerant outflow side of the first expansion mechanism. The second expansion mechanism is connected to an exit side of the liquid receiver. The evaporator is connected to a refrigerant outflow side of the second expansion mechanism and to a refrigerant intake side of the compression mechanism. The pressure detector is provided between the refrigerant discharge side of the compression mechanism and the refrigerant inflow side of the first expansion mechanism. The temperature detector is provided between the exit side of the radiator and the refrigerant inflow side of the first expansion mechanism. The control unit controls the first expansion mechanism using the pressure detected by the pressure detector and the temperature detected by the temperature detector so that the refrigerant flowing out from the first expansion mechanism reaches a saturated state. As used herein, the term "saturated state" refers to a state substantially sufficient to allow a roughly constant amount of liquid refrigerant to be stored in the liquid receiver, and may have some latitude in interpretation.

In this refrigeration device, the control unit controls the first expansion mechanism using the pressure detected by the pressure detector and the temperature detected by the temperature detector so that the refrigerant flowing out from the first expansion mechanism reaches a saturated state. For this reason, the refrigerant flowing out from the first expansion mechanism in the refrigeration device generates substantially no refrigerant gas. It is therefore possible to stably control the refrigerant level in the liquid receiver of the refrigeration device.

A refrigeration device according to a second aspect of the present invention is the refrigeration device according to the first aspect of the present invention, wherein the control unit calculates saturation pressure from the pressure and the temperature, and controls the first expansion mechanism so that the pressure of the refrigerant flowing out from the first expansion mechanism reaches the saturation pressure.

In this refrigeration device, the control unit calculates saturation pressure from the pressure and the temperature, and controls the first expansion mechanism so that the pressure of the refrigerant flowing out from the first expansion mechanism reaches the saturation pressure. For this reason, the refrigerant flowing out from the first expansion mechanism in the refrigeration device generates substantially no refrigerant gas. It is therefore possible to stably control the refrigerant level in the liquid receiver of the refrigeration device.

A refrigeration device according to a third aspect of the present invention is the refrigeration device according to the second aspect of the present invention, wherein the control unit calculates enthalpy from the pressure and the temperature, and calculates a saturation pressure that corresponds to the enthalpy.

In this refrigeration device, the control unit calculates enthalpy from the pressure and the temperature, and calculates a saturation pressure that corresponds to the enthalpy. Specifically, a line is drawn directly down from the refrigerant outflow point of the first expansion mechanism on a Mollier diagram, and pressure is determined at a point of intersection of this line with the saturation line for this refrigeration device. The target saturation pressure can therefore be easily determined in a case in which the first expansion mechanism of the refrigeration device is an expansion valve.

A refrigeration device according to a fourth aspect of the present invention is the refrigeration device according to the second or third aspect of the present invention, wherein the control unit controls the first expansion mechanism so that the pressure of the refrigerant flowing out from the first expansion mechanism is equal to or less than an upper-limit pressure greater than the saturation pressure, and is equal to or greater than a lower-limit pressure less than the saturation pressure. "The upper-limit pressure" and "lower-limit pressure" referred to herein are determined so as to substantially allow a roughly constant amount of liquid refrigerant to be stored in the liquid receiver.

In this refrigeration device, the control unit controls the first expansion mechanism so that the pressure of the refrigerant flowing out from the first expansion mechanism is equal to or less than an upper-limit pressure greater than the saturation pressure, and is equal to or greater than a lower-limit pressure less than the saturation pressure. For this reason, the refrigerant flowing out from the first expansion mechanism in the refrigeration device generates substantially no refrigerant gas. It is therefore possible to stably control the refrigerant level in the liquid receiver of the refrigeration device.

A refrigeration device according to a fifth aspect of the present invention is the refrigeration device according to any of the first to fourth aspects of the present invention, wherein the first expansion mechanism is a first expansion valve. Also, the second expansion mechanism is a second expansion valve. The control unit controls the distribution of the degree of opening of the first expansion valve and the degree of opening of the second expansion valve.

In this refrigeration device, the control unit controls the distribution of the degree of opening of the first expansion valve and the degree of opening of the second expansion valve. It is therefore possible to stably control the refrigerant level in the liquid receiver while taking into account the degree of superheating or the like of the refrigerant near the intake port of the compressor in the refrigeration device.

Advantageous Effects of Invention

In the refrigeration device according to the first through third aspects, the refrigerant flowing out from the first expansion mechanism generates substantially no refrigerant gas. It is therefore possible to stably control the refrigerant level in the liquid receiver of the refrigeration device.

In the refrigeration device according to the fourth aspect of the present invention, it is possible to stably control the refrigerant level in the liquid receiver while taking into account the degree of superheating or the like of the refrigerant near the intake port of the compressor.

DETAILED DESCRIPTION OF THE INVENTION

<Structure of Air Conditioning Device>

Figure 1:
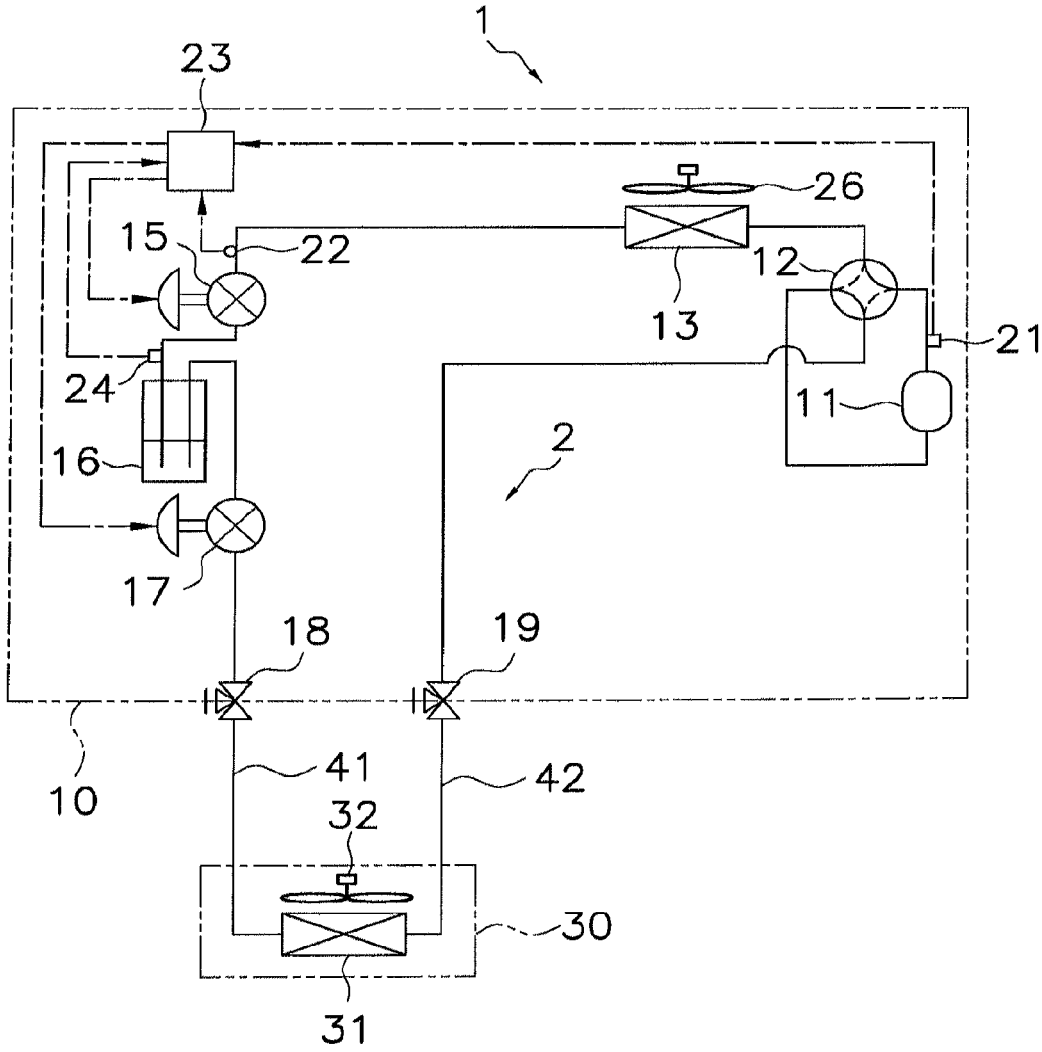
FIG. 1 is a diagram showing the refrigerant circuit of an air conditioning device according to an embodiment of the present invention.

FIG. 1 is a schematic view of the refrigerant circuit 2 of the air conditioning device 1 according to an embodiment of the present invention.

This air conditioning device 1 is an air conditioning device that is capable of cooling operation and heating operation using carbon dioxide as the refrigerant, and is primarily composed of a refrigerant circuit 2, blower fans 26, 32, a control device 23, a high-pressure sensor 21, a temperature sensor 22, an intermediate-pressure sensor 24, and other components.

The refrigerant circuit 2 is equipped primarily with a compressor 11, a four-way switch valve 12, an outdoor heat exchanger 13, a first electric expansion valve 15, a liquid receiver 16, a second electric expansion valve 17, and an indoor heat exchanger 31, and the devices are connected via a refrigerant pipe, as shown in FIG. 1.

In the present embodiment, the air conditioning device 1 is a separate-type air conditioning device, and can also be described as comprising an indoor unit 30 primarily having the indoor heat exchanger 31 and an indoor fan 32; an outdoor unit 10 primarily having the compressor 11, the four-way switch valve 12, the outdoor heat exchanger 13, the first electric expansion valve 15, the liquid receiver 16, the second electric expansion valve 17, the high-pressure sensor 21, the temperature sensor 22, and the control device 23; a first connecting pipe 41 for connecting the pipe for refrigerant fluid and the like of the indoor unit 30 and the pipe for refrigerant fluid and the like of the outdoor unit 10; and a second connecting pipe 42 for connecting the pipe for refrigerant gas and the like of the indoor unit 30 and the pipe for refrigerant gas and the like of the outdoor unit 10. The first connecting pipe 41 and the pipe for refrigerant fluid and the like of the outdoor unit 10 are connected via a first close valve 18 of the outdoor unit 10, and the second connecting pipe 42 and the pipe for refrigerant gas and the like of the outdoor unit 10 are connected via a second close valve 19 of the outdoor unit 10.

(1) Indoor Unit

The indoor unit 30 primarily has the indoor heat exchanger 31, the indoor fan 32, and other components.

The indoor heat exchanger 31 is a heat exchanger for exchanging heat between the refrigerant and the indoor air, which is the air inside the room to be air-conditioned.

The indoor fan 32 is a fan for taking the air inside the air-conditioned room into the unit 30 and blowing conditioned air, which is the air after heat exchange with the refrigerant via the indoor heat exchanger 31, back into the air-conditioned room.

Employing such a configuration makes it possible for the indoor unit 30 to cause heat to be exchanged between the indoor air taken in by the indoor fan 32 and the liquid refrigerant that flows through the indoor heat exchanger 31, and generate conditioned air (cool air) during cooling operation, as well as to cause heat to be exchanged between the indoor air taken in by the indoor fan 32 and supercritical refrigerant that flows through the indoor heat exchanger 31, and generate conditioned air (warm air) during heating operation.

(2) Outdoor Unit

The outdoor unit 10 primarily has the compressor 11, the four-way switch valve 12, the outdoor heat exchanger 13, the first electric expansion valve 15, the liquid receiver 16, the second electric expansion valve 17, an outdoor fan 26, the control device 23, the high-pressure sensor 21, the temperature sensor 22, the intermediate-pressure sensor 24, and other components.

The compressor 11 is a device for sucking in low-pressure refrigerant gas flowing through an intake pipe and compressing the refrigerant gas to a supercritical state, and then discharging the refrigerant to a discharge pipe.

The four-way switch valve 12 is a valve for switching the flow direction of the refrigerant in accordance with each operation mode, and is capable of connecting the discharge side of the compressor 11 and the high-temperature side of the outdoor heat exchanger 13, and connecting the intake side of the compressor 11 and the gas side of the indoor heat exchanger 31 during cooling operation; as well as connecting the discharge side of the compressor 11 and the second close valve 19, and connecting the intake side of the compressor 11 and the gas side of the outdoor heat exchanger 13 during heating operation.

The outdoor heat exchanger 13 is capable of cooling the high-pressure supercritical refrigerant discharged from the compressor 11 using the air outside the air-conditioned room as a heat source during cooling operation, and evaporating the liquid refrigerant returning from the indoor heat exchanger 31 during heating operation.

The first electric expansion valve 15 reduces the pressure of the supercritical refrigerant (during cooling operation) that flows out from the low-temperature side of the outdoor heat exchanger 13, or the liquid refrigerant (during heating operation) that flows in through the liquid receiver 16.

The liquid receiver 16 stores refrigerant that occurs as excess depending on the operating mode or the air conditioning load.

The second electric expansion valve 17 reduces the pressure of the liquid refrigerant (during cooling operation) that flows in through the liquid receiver 16, or the supercritical refrigerant (during heating operation) that flows out from the low-temperature side of the indoor heat exchanger 31.

The outdoor fan 26 is a fan for taking the outdoor air into the unit 10 and discharging the air after heat exchange with the refrigerant via the outdoor heat exchanger 13.

The high-pressure sensor 21 is provided to the discharge side of the compressor 11.

The temperature sensor 22 is provided on the outdoor heat exchanger side of the first electric expansion valve 15.

The intermediate-pressure sensor 24 is provided between the first electric expansion valve 15 and the liquid receiver 16.

Figure 2:
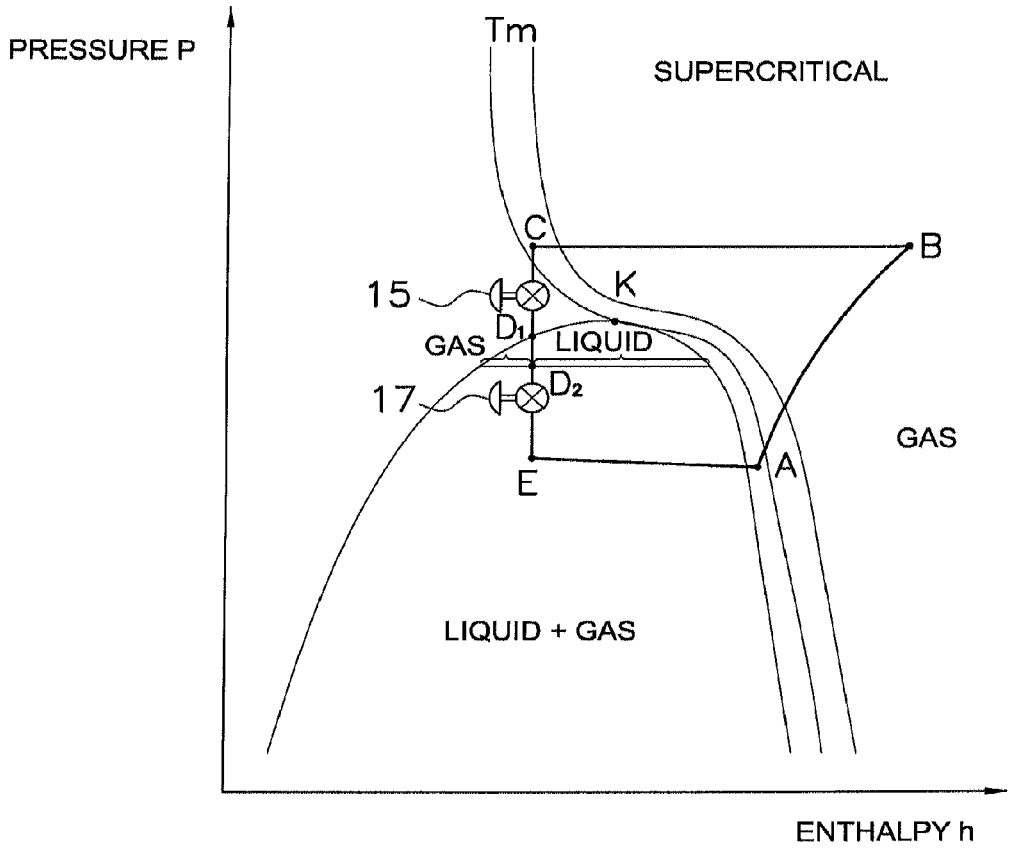
FIG. 2 is a diagram for describing refrigerant cooling control by a control device of the air conditioning device according to an embodiment of the present invention.

The control device 23 has a communication connection with the high-pressure sensor 21, the temperature sensor 22, the intermediate-pressure sensor 24, the first electric expansion valve 15, the second electric expansion valve 17, and other components, and controls the degree of opening of the first electric expansion valve 15 and the second electric expansion valve 17 on the basis of temperature information transmitted from the temperature sensor 22, high-pressure information transmitted from the high-pressure sensor 21, and intermediate-pressure information transmitted from the intermediate-pressure sensor 24. Control of the degree of opening of the first electric expansion valve 15 and the second electric expansion valve 17 will be described in detail using Mollier diagram. FIG. 2 shows the refrigeration cycle of the air conditioning device 1 according to the present embodiment on a Mollier diagram for carbon dioxide. In FIG. 2, A→B indicates the compression stroke, B→C indicates the cooling stroke, C→$D_1$, $D_2$ indicates the first expansion stroke (pressure reduction by the first electric expansion valve 15), $D_1$, $D_2$→E indicates the second expansion stroke (pressure reduction by the second electric expansion valve 17), and E→A indicates the evaporation stroke. Also, K indicates a critical point, and Tm indicates an isothermal line. During the refrigeration cycle A→B→C→$D_2$→E→A, the refrigerant that flows out from the first electric expansion valve 15 is in a gas-liquid two-phase state, and refrigerant gas is generated. However, since the high-pressure sensor 21 is disposed on the discharge side of the compressor 11, and the temperature sensor 22 is disposed on the outdoor heat exchanger side of the first electric expansion valve 15 in the air conditioning device 1 of the present embodiment, the saturation pressure of the refrigerant that flows out from the first electric expansion valve 15 can be calculated using a Mollier diagram. In view of this, the control device 23 in the air conditioning device 1 appropriately adjusts the degree of opening of the first electric expansion valve 15 and the second electric expansion valve 17 so that the refrigerant flowing out from the first electric expansion valve 15 is in the state of point $D_1$; i.e., that the value indicated by the intermediate-pressure sensor 24 corresponds to the saturation pressure determined as described above. This causes the refrigeration cycle to assume the form A→B→C→$D_1$→E→A. Specifically, the refrigerant flowing out from the first electric expansion valve 15 can attain the state of point $D_1$, i.e., a saturated state.

<Operation of the Air Conditioning Device>

The operation of the air conditioning device 1 will be described using FIG. 1. This air conditioning device 1 is capable of cooling operation and heating operation, as described above.

(1) Cooling Operation

During cooling operation, the four-way switch valve 12 is in the state indicated by the solid line in FIG. 1, i.e., a state in which the discharge side of the compressor 11 is connected to the high-temperature side of the outdoor heat exchanger 13, and the intake side of the compressor 11 is connected to the second close valve 19. The first close valve 18 and the second close valve 19 are also open at this time.

When the compressor 11 is activated in this state of the refrigerant circuit 2, the refrigerant gas is sucked into the compressor 11 and compressed to a supercritical state, and then sent through the four-way switch valve 12 to the outdoor heat exchanger 13 and cooled in the outdoor heat exchanger 13.

This cooled supercritical refrigerant is sent to the first electric expansion valve 15. The supercritical refrigerant sent to the first electric expansion valve 15 is depressurized to a saturated state, and then sent to the second electric expansion valve 17 via the liquid receiver 16. The refrigerant in a saturated state sent to the second electric expansion valve 17 is depressurized to liquid refrigerant, and then fed to the indoor heat exchanger 31 via the first close valve 18, where the refrigerant cools the indoor air and evaporates into refrigerant gas.

The refrigerant gas is again sucked into the compressor 11 via the second close valve 19, and the four-way switch valve 12. Cooling operation is performed in this manner. The control device 23 performs the control described above in this cooling operation.

(2) Heating Operation

During heating operation, the four-way switch valve 12 is in the state indicated by the dashed line in FIG. 1, i.e., a state in which the discharge side of the compressor 11 is connected to the second close valve 19, and the intake side of the compressor 11 is connected to the gas side of the outdoor heat exchanger 13. The first close valve 18 and the second close valve 19 are also open at this time.

When the compressor 11 is activated in this state of the refrigerant circuit 2, the refrigerant gas is sucked into the compressor 11 and compressed to a supercritical state, and then is fed to the indoor heat exchanger 31 via the four-way switch valve 12 and the second close valve 19.

The supercritical refrigerant heats the indoor air, and is cooled in the indoor heat exchanger 31. The cooled supercritical refrigerant is sent through the first close valve to the second electric expansion valve 17. The supercritical refrigerant sent to the second electric expansion valve 17 is depressurized to a saturated state, and then sent to the first electric expansion valve 15 via the liquid receiver 16. The refrigerant in a saturated state sent to the first electric expansion valve 15 is depressurized to liquid refrigerant, and then sent to the outdoor heat exchanger 13 and evaporated to refrigerant gas in the outdoor heat exchanger 13. This refrigerant gas is again sucked into the compressor 11 via the four-way switch valve 12. Heating operation is performed in this manner.

<Characteristics of the Air Conditioning Device>

(1)

In the air conditioning device 1 according to the present embodiment, the control device 23 has a communication connection with the high-pressure sensor 21, the temperature sensor 22, the first electric expansion valve 15, the second electric expansion valve 17, and other components, and controls the degree of opening of the first electric expansion valve 15 and the second electric expansion valve 17 on the basis of temperature information transmitted from the temperature sensor 22 and high-pressure information transmitted from the high-pressure sensor 21 so that the refrigerant flowing out from the first electric expansion valve 15 is in a saturated state. For this reason, the refrigerant flowing out from the first electric expansion valve 15 in the air conditioning device 1 generates substantially no refrigerant gas. It is therefore possible to stably control the refrigerant level in the liquid receiver 16 of the air conditioning device 1.

(2)

In the air conditioning device 1 according to the present embodiment, it may be conceivable, for example, that the total degree of opening of the first electric expansion valve 15 and the second electric expansion valve 17 may be expressed as a function in advance using the degree of superheating in the intake pipe of the compressor 11 as the variable, for example, or a control table or the like may be created that shows the relationship of the total degree of opening and the degree of superheating, and the ratio of the degree of opening of the first electric expansion valve 15 and the second electric expansion valve 17 may thereby be expressed as a function in advance using the high pressure and the entry temperature of the first electric expansion valve as variables. It is therefore possible to stably control the refrigerant level in the liquid receiver 16 while taking into account the degree of superheating or the like of the refrigerant near the intake port of the compressor 11 in the air conditioning device 1.

Modifications (A)

Figure 3:
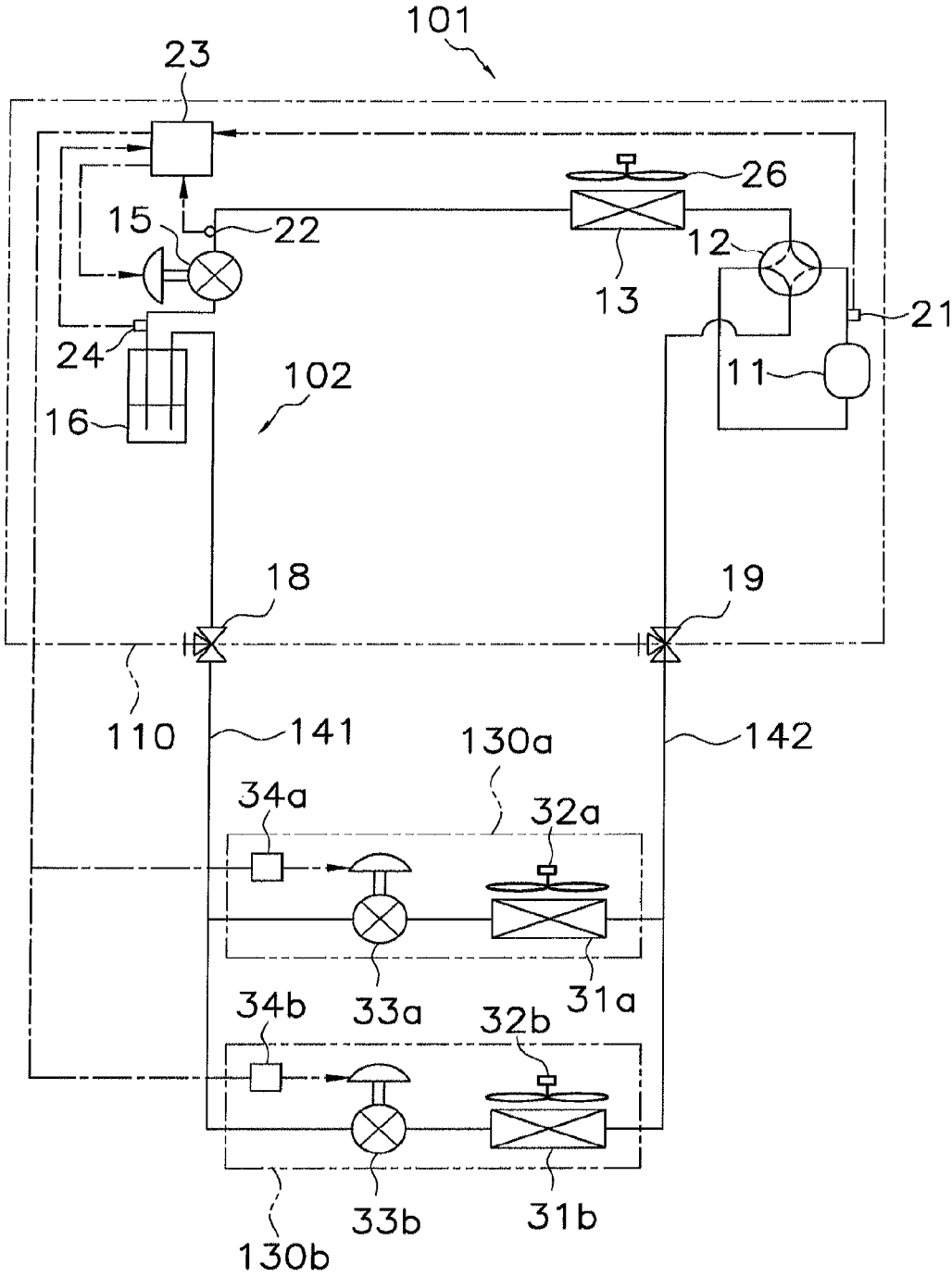
FIG. 3 is a diagram showing the refrigerant circuit of an air conditioning device according to Modification (A).

In the embodiment described above, the invention of the present application is applied to a separate-type air conditioning device 1 in which one indoor unit 30 is provided for one outdoor unit 10, but the invention of the present application may also be applied to a multi-type air conditioning device 101 in which a plurality of indoor units is provided for one outdoor unit shown in FIG. 3. In FIG. 3, the same reference numerals are used to refer to components that are the same as those of the air conditioning device 1 according to the embodiment described above. In FIG. 3, the reference numeral 102 refers to a refrigerant circuit, 110 refers to an outdoor unit, 130*a* and 130*b* refer to indoor units, 31*a* and 31*b* refer to indoor heat exchangers, 32*a* and 32*b* refer to indoor fans, 33*a* and 33*b* refer to second electric expansion valves, 34*a* and 34*b* refer to indoor control devices, and 141 and 142 refer to connecting pipes. In this case, the control device 23 controls the second electric expansion valves 33*a*, 33*b* via the indoor control devices 34*a*, 34*b*. The second electric expansion valves 33*a*, 33*b* are housed in the indoor units 130*a*, 130*b* in the present modification, but the second electric expansion valves 33*a*, 33*b* may alternatively be housed in the outdoor unit 110.

(B)

Figure 4:
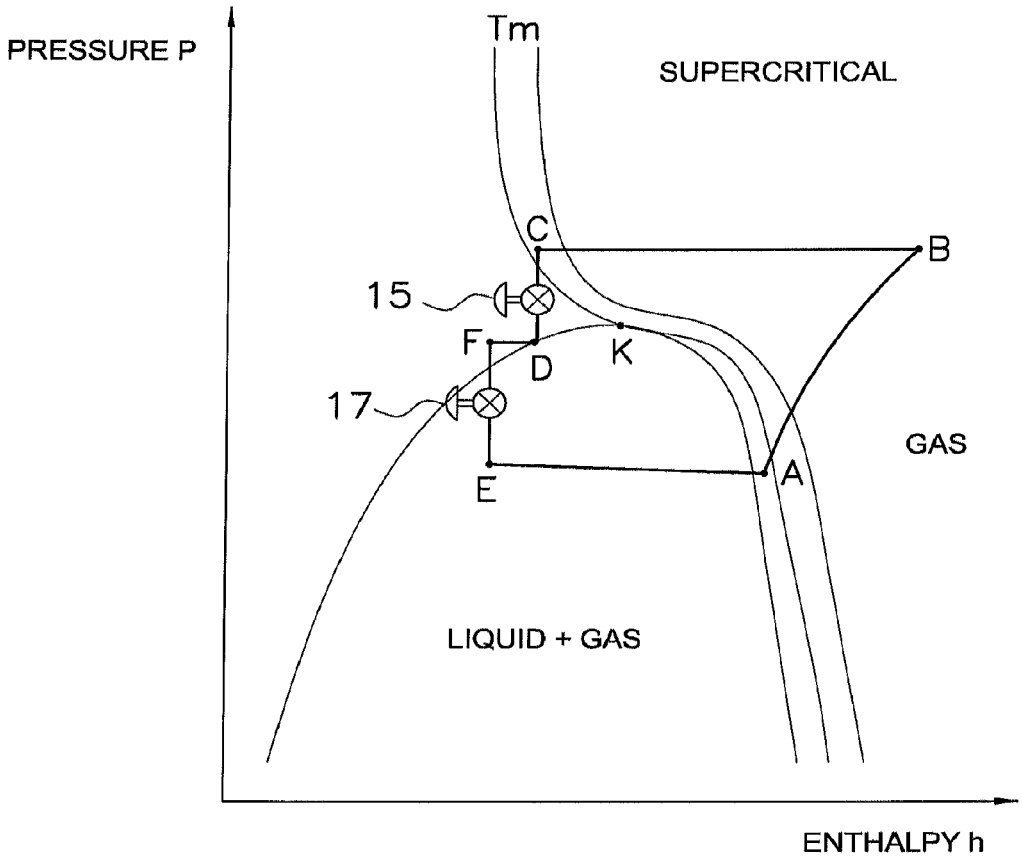
FIG. 4 is a diagram for describing control carried out by a control device of an air conditioning device according to Modification (B).

In the air conditioning device 1 according to the embodiment described above, although not particularly mentioned in the above description, a supercooling heat exchanger (which may also be an internal heat exchanger) may be provided between the liquid receiver 16 and the second electric expansion valve 17. In this case, the refrigeration cycle on the Mollier diagram is as shown in FIG. 4. In FIG. 4, A→B indicates the compression stroke, B→C indicates the first cooling stroke, C→D indicates the first expansion stroke, D→F indicates the second cooling stroke (cooling by the supercooling heat exchanger), F→E indicates the second expansion stroke, and E→A indicates the evaporation stroke.

(C)

In the air conditioning device 1 according to the embodiment described above, the first electric expansion valve 15, the liquid receiver 16, the second electric expansion valve 17, and other components are disposed in the outdoor unit 10, but the positioning of these components is not particularly limited. For example, the second electric expansion valve 17 may be disposed in the indoor unit 30.

(D)

An electric expansion valve is used as the means for reducing the pressure of the refrigerant in the air conditioning device 1 according to the embodiment described above, but an expansion device or the like may instead be used.

(E)

Although not particularly mentioned in the air conditioning device 1 according to the embodiment described above, the liquid receiver 16 and the intake pipe of the compressor 11 may be connected to form a gas release circuit. In this case, an electric expansion valve, an electromagnetic valve, or the like is preferably provided to the gas release circuit.

(F)

In the air conditioning device 1 according to the embodiment described above, the control device 23 appropriately adjusts the degree of opening of the first electric expansion valve 15 and the second electric expansion valve 17 so that the value indicated by the intermediate-pressure sensor 24 corresponds to the calculated target saturation pressure, but it is also possible for the control device 23 to determine the maximum target pressure and the minimum target pressure from the target saturation pressure, and to control the degree of opening of the first electric expansion valve 15 and the second electric expansion valve 17 so that the value indicated by the intermediate-pressure sensor 24 is equal to or less than the maximum target pressure, and is equal to or greater than the minimum target pressure.

(G)

The intermediate-pressure sensor 24 is provided in the air conditioning device 1 according to the embodiment described above, but the intermediate-pressure sensor 24 may also be omitted. In this case, it may be conceivable, for example, that the total degree of opening of the first electric expansion valve 15 and the second electric expansion valve 17 may be expressed as a function in advance using the degree of superheating in the intake pipe of the compressor 11 as the variable, for example, or a control table or the like may be created that shows the relationship between the total degree of opening and the degree of superheating, and the ratio of the degree of opening of the first electric expansion valve 15 and the second electric expansion valve 17 may thereby be expressed as a function in advance using the high pressure and the entry temperature of the first electric expansion valve as variables. The degree of opening of the first electric expansion valve 15 and the second electric expansion valve 17 can thereby be uniquely determined.

(H)

Although not particularly mentioned in the embodiment described above, the present invention is also applicable to two-stage compression.

(I)

The intermediate-pressure sensor 24 is provided in the air conditioning device 1 according to the embodiment described above, but the intermediate-pressure sensor 24 may be omitted when the high-pressure and the entry temperature of the first electric expansion valve 15 are fixed. In this case, a temperature sensor may be provided between the refrigerant outflow side of the first electric expansion valve 15 and the refrigerant inflow side of the second electric expansion valve 17 to measure the saturation temperature.

(J)

The intermediate-pressure sensor 24 is provided in the air conditioning device 1 according to the embodiment described above, but the intermediate-pressure sensor 24 may be omitted when a low-pressure sensor is provided between the exit side of the indoor heat exchanger 31 and the intake side of the compressor 11, and a temperature sensor is provided near the entrance of the first electric expansion valve 15 (or near the port on the low-temperature side (or liquid side) of the outdoor heat exchanger 13). In this case, the intermediate pressure is predicted using the degree of opening/differential pressure characteristic of the first electric expansion valve 15 and the second electric expansion valve 17.

(K)

In the air conditioning device 1 according to the embodiment described above, although not particularly mentioned in the above description, a heat exchanger for cooling the refrigerant (or an internal heat exchanger) may be provided between the temperature sensor 22 and the low-temperature side (or liquid side) of the outdoor heat exchanger 13. In this case, the refrigerant flowing out from the first electric expansion valve 15 can be prevented from reaching a state near the critical point. It is therefore possible to stably control the level of liquid in the liquid receiver of the air conditioning device 1.

INDUSTRIAL APPLICABILITY

The refrigeration device of the present invention has the characteristic of enabling the refrigerant level in the liquid receiver to be stably controlled, and the present invention is particularly useful in a refrigeration device in which carbon dioxide or the like is used as the refrigerant.

What is claimed is:

1. A refrigeration device comprising:

a compression mechanism configured to compress a refrigerant;

a radiator connected to a refrigerant discharge side of said compression mechanism;

a first expansion mechanism connected to an exit side of said radiator;

a liquid receiver connected to a refrigerant outflow side of said first expansion mechanism;

a second expansion mechanism connected to an exit side of said liquid receiver;

an evaporator connected to a refrigerant outflow side of said second expansion mechanism and to a refrigerant intake side of said compression mechanism;

a pressure detector arranged to detect a refrigerant pressure between the refrigerant discharge side of said compression mechanism and a refrigerant inflow side of said first expansion mechanism;

a temperature detector arranged to detect a refrigerant temperature between the exit side of said radiator and the refrigerant inflow side of said first expansion mechanism; and a control unit configured to control said first expansion mechanism using the refrigerant pressure detected by said pressure detector and the refrigerant temperature detected by said temperature detector so that refrigerant flowing out from said first expansion mechanism reaches a saturated state, said control unit being configured to calculate saturation pressure from the refrigerant pressure detected by said pressure detector and the refrigerant temperature detected by said temperature detector, and the control unit being further configured to control said first expansion mechanism so that a pressure of refrigerant flowing out from said first expansion mechanism reaches said saturation pressure.

2. The refrigeration device according to claim 1, wherein said control unit is further configured to calculate enthalpy from the refrigerant pressure detected by said pressure detector and the refrigerant temperature detected by said temperature detector, and said control unit is further configured to calculate a saturation pressure corresponding to said enthalpy.

3. The refrigeration device according to claim 2, wherein said control unit is further configured to control said first expansion mechanism so that the pressure of refrigerant flowing out from said first expansion mechanism is equal to or less than an upper-limit pressure and is equal to or greater than a lower-limit pressure, the upper-limit pressure is greater than said saturation pressure, and the tower-limit pressure is less than said saturation pressure.

4. The refrigeration device according to claim 3, wherein said first expansion mechanism is a first expansion valve;

said second expansion mechanism is a second expansion valve; and said control unit is further configured to control a distribution of a degree of opening of said first expansion valve and to control a degree of opening of said second expansion valve.

5. The refrigeration device according to claim 2, wherein said first expansion mechanism is a first expansion valve;

said second expansion mechanism is a second expansion valve; and said control unit is further configured to control a distribution of a degree of opening of said first expansion valve and to control a degree of opening of said second expansion valve.

6. The refrigeration device according to claim 1, wherein said control unit is further configured to control said first expansion mechanism so that the pressure of refrigerant flowing out from said first expansion mechanism is equal to or less than an upper-limit pressure and is equal to or greater than a lower-limit pressure, the upper-limit pressure is greater than said saturation pressure, and the lower-limit pressure is less than said saturation pressure.

7. The refrigeration device according to claim 6, wherein said first expansion mechanism is a first expansion valve;

said second expansion mechanism is a second expansion valve; and said control unit is further configured to control a distribution of a degree of opening of said first expansion valve and to control a degree of opening of said second expansion valve.

8. The refrigeration device according to claim 1, wherein said first expansion mechanism is a first expansion valve;

said second expansion mechanism is a second expansion valve; and said control unit is further configured to control a distribution of a degree of opening of said first expansion valve and to control a degree of opening of said second expansion valve.

9. The refrigeration device according to claim 1, wherein said first expansion mechanism is a first expansion valve;

said second expansion mechanism is a second expansion valve; and said control unit is further configured to control a distribution of a degree of opening of said first expansion valve and to control a degree of opening of said second expansion valve.

* * * * *